United States Patent [19]

Cochran

[11] 4,125,750

[45] Nov. 14, 1978

[54] HIGH VOLTAGE ELECTRICAL SWITCH

[75] Inventor: John P. Cochran, Lexington, Ky.

[73] Assignee: Kuhlman Corporation, Troy, Mich.

[21] Appl. No.: 725,574

[22] Filed: Sep. 22, 1976

[51] Int. Cl.[2] ..... H01H 33/04; H01H 9/30

[52] U.S. Cl. ..... 200/144 R; 200/62; 200/66; 200/68; 200/146 R

[58] Field of Search ..... 200/144 R, 146 R, 150 C, 200/11 TC, 11 J, 11 R, 153 K, 66, 62, 63 R, 67 C

[56] References Cited

U.S. PATENT DOCUMENTS

| | | | |
|---|---|---|---|
| 570,418 | 10/1896 | Wurts | 200/146 R |
| 592,497 | 10/1897 | Scott | 200/146 A |
| 891,306 | 6/1908 | Van Valkenburg | 200/150 C |
| 2,337,889 | 12/1943 | Harlow et al. | 200/62 |
| 2,644,877 | 7/1953 | Guillaume | 200/150 C |
| 2,871,702 | 2/1959 | Tetro | 200/66 |
| 3,055,227 | 9/1962 | Martin | 200/68 |

FOREIGN PATENT DOCUMENTS

| | | | |
|---|---|---|---|
| 5,943 of | 1915 | United Kingdom | 200/146 R |

*Primary Examiner*—Robert S. Macon

*Attorney, Agent, or Firm*—Harness, Dickey & Pierce

[57] ABSTRACT

A switch adapted to interrupt high voltage electrical currents by directing an extended curvilinear arc plasma path within a fluid insulating medium. The preferred embodiment of the switch is designed to store rotational energy in a motor spring, release the stored rotational energy, and latch an opposite motor spring all in the same movement of the operator's handle. The switch also includes a mechanical overdrive unit that permits the operator's handle to be rotated only a fraction of the total rotation travelled by the movable contact. In addition, an anti-stick or weld break feature is provided that manually initiates rotation of the movable contact in the event of adhesion between the contacts. Finally, a novel contact design is disclosed which aids in controlling the path of the arc plasma as well as providing multiple contact paths to insure that proper physical connecton is made between the contacts.

58 Claims, 26 Drawing Figures

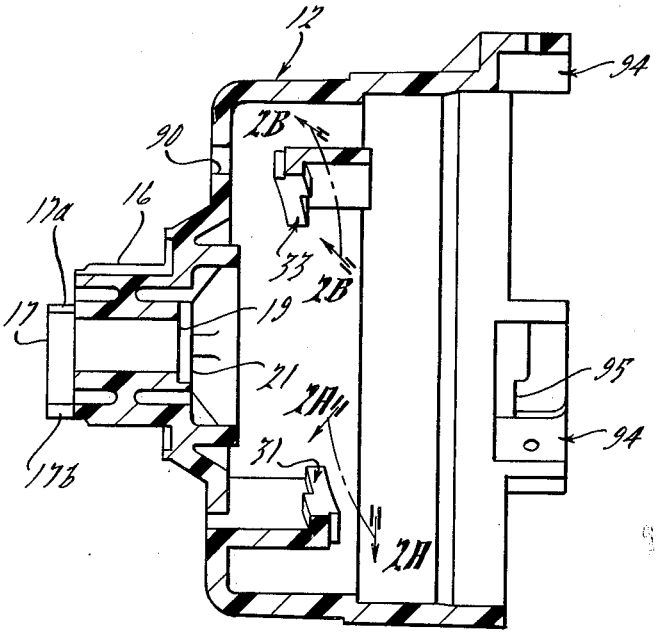
FIG. 2.
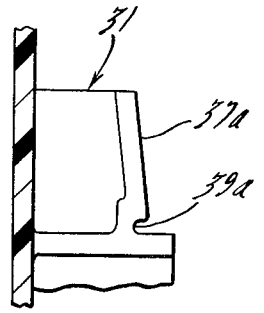
FIG. 2A.
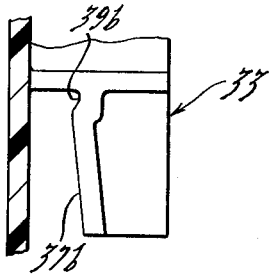
FIG. 2B.
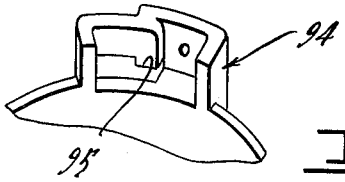
FIG. 2C.
FIG. 4.
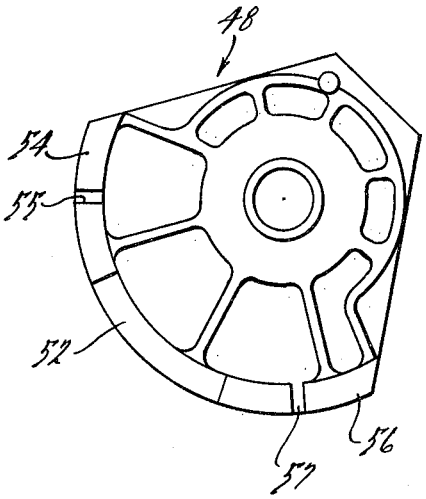
FIG. 5.
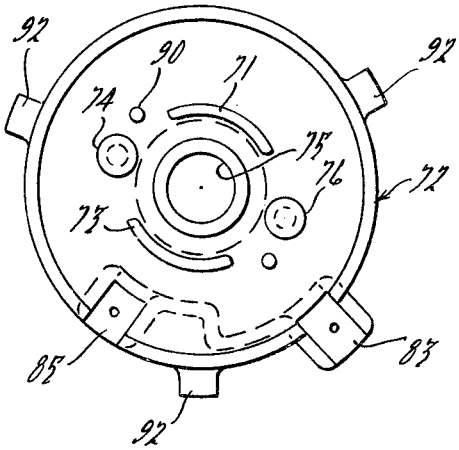

HIGH VOLTAGE ELECTRICAL SWITCH

BACKGROUND AND SUMMARY OF THE INVENTION

The present invention relates to a device for interrupting high voltage currents and in particular to an improved high voltage switch that has a substantially greater voltage interrupting capability than other switches of comparable size.

It has long been recognized in high voltage applications that arc plasma is generated between points of transmission during a switching operation. The arc plasma, of course, is created by the continued transmission that occurs across a gap between two contacts due to the high voltage potential present. As long as the resistance between the two contacts remains below the conductivity ceiling necessary to support the arc plasma, a current will continue to be conducted across the contacts even though they are physically separated.

Original attempts to interrupt high voltage currents sought to minimize the effect of the arc plasma by increasing the dielectric strength of the medium between the two contacts. Thus, the liquid switch was developed which submerged the contacts in a fluid, such as oil, to aid in cooling the arc plasma so as to limit the intensity of the arc generated. The immersion of the contacts in oil also aided in controlling the problem of abnormal arcing which often occurred between alternative points exposed to electrical stress during the switching operation.

Additional efforts to combat the problem included attempts to extinguish rather than to control the arc plasma generated. These devices sought to interrupt current flow by such means as injecting a pressurized jet of fluid at the arc plasma upon separation of the energized contacts to effect extinction thereof. However, the effectiveness of such devices in handling high voltage currents was dubious at best.

In fact, since the advent of the oil switch, little has changed in the way of new technology to handle the substantially higher voltage potentials encountered in today's power systems. Essentially, the increased capacity requirements have been satisfied simply by making the size of the switches larger. Specifically, the movement of one contact relative to the other has been increased to increase the dielectric strength between the two contacts. Since it has always been assumed that the arc plasma takes the shortest possible path exposed to electrical stress, the increased contact movement has always followed a substantially linear path. Thus, the overall dimensions of the switch were enlarged to accommodate the greater distance between the two stationary switching positions.

It is this basic misconception of the prior art from which the present invention makes a dramatic departure. Although it is true that arc plasma will follow the path of least resistance, it does not necessarily follow that the path of least resistance corresponds to the shortest distance between the two energized contacts. Rather, the intense heat of the arc plasma generates a gas bubble which assumes a column-like form about the arc plasma as the length of the arc is extended. Additionally, the dielectric strength within the gas column is substantially less than the dielectric strength of the surrounding fluid insulating medium. Thus, as long as the gas column can be controlled, the path of the arc plasma can also be controlled.

Thus, it is the primary object of the present invention to provide a device for interrupting high voltage electrical currents by controlling the arc plasma generated so that it substantially follows an extended predetermined path within a substantially reduced volume as compared to devices having comparable voltage capacities.

In addition, the present invention provides a high voltage electrical switch that is inexpensive to manufacture and is readily assembled without requiring any tools or special hardware.

Furthermore, as will be appreciated by those skilled in the art, the present invention provides a high voltage electrical switch that improves the reliability of the switching operation and yet is simple to operate.

Moreover, it will be seen that although the preferred embodiment discloses a single-pole device, the design is readily adaptable to a multiple-pole arrangement.

In general, the preferred embodiment comprises a rotary type switch having its contact elements immersed in a fluid insulating medium. The switch is preferably adapted to rotate its movable contact approximately three quarters of a revolution upon rotation of the operator's handle about a quarter of a revolution. The total rotation of the operator's handle is preferably limited for ease of operation. Specifically, since high voltage switches of this type are frequently operated with a "hot stick", it will be appreciated that it becomes increasingly difficult to rotate the operator's handle over a distance much greater than 90°.

In addition, the preferred embodiment of the switch is designed to perform the entire switching operation upon the simple rotation of the operator's handle. The rotational energy from the operator's handle is stored in a motor spring which rapidly releases its stored rotational energy when unlatched by a cam. The cam is adapted to rotate with the operator's handle to initially store rotational energy in the motor spring and subsequently to release the rotational energy in the motor spring during the last few degrees of rotation. The rotational energy from the motor spring is applied to the input of a mechanical overdrive unit which is designed to provide approximately three times the amount of rotation at its output as is applied to its input. The output from the overdrive unit is directly coupled to the movable contact element of the switch. Thus, it can be seen that in response to the input rotation of 85°, the switch is designed to rotate the movable contact approximately 255°.

When the movable contact reaches its extent of travel, an oppositely sprung motor spring is automatically latched. To return the switch to its original closed position, the operator's handle is simply rotated in the opposite direction causing rotational energy to be stored in the opposite motor spring until the energy is released by the cam as previously discussed. The switch provides means for rapidly returning the movable contact to its original position to minimize arcing between the contacts when the switch is closed. Thus, as will subsequently be explained in greater detail, the present invention discloses a device which performs the storing, tripping, driving, and latching functions all in a single motion of the operator's handle.

In addition, an anti-stick or anti-weld feature is incorporated into the design of the device to initiate contact movement in the event that the motor spring is unable to move the contact when freed by the cam. More specifically, if the motor spring does not immediately release its stored rotational energy when unlatched, the cam is further designed to transmit the next few degrees of operator handle movement directly to the input of the overdrive unit. This results in contact movement of approximately three times the additional handle movement, which is sufficient to initiate normal switching operation.

The present invention also discloses a novel switching element that includes a unique contact design providing multiple contact paths and an "arc horn" which aids in the control of the arc plasma as well as providing a sacrificial segment in the event of a fault-make switching condition.

Finally, it will be seen from the following detailed description, that the preferred embodiment of the high voltage switch according to the present invention is readily assembled without the use of special tools, and includes means for preventing the accidental disassembly of the switch during operation thereof.

BRIEF DESCRIPTION OF THE DRAWINGS

The following detailed description of the preferred embodiment of the present invention makes reference to the following set of drawings in which:

FIG. 2 is a sectional view of the housing member shown in FIG. 1;

FIG. 2*a* is a sectional view of the rear stop of the housing of FIG. 2 taken along line *a—a;*

FIG. 2*b* is a sectional view of the front stop of the housing of FIG. 2 taken along line *b—b;*

FIG. 2*c* is a detailed view of the latch portion of the housing shown in FIG. 2;

FIG. 4 is another view of the drive gear shown in FIG. 1 taken along line 4—4;

FIG. 5 is another view of the bearing plate shown in FIG. 1 taken along line 5—5;

FIG. 6 is another view of the motor springs shown in FIG. 1 taken along line 6—6;

DETAILED DESCRIPTION OF THE PREFERRED EMBODIMENT

Figure 1:
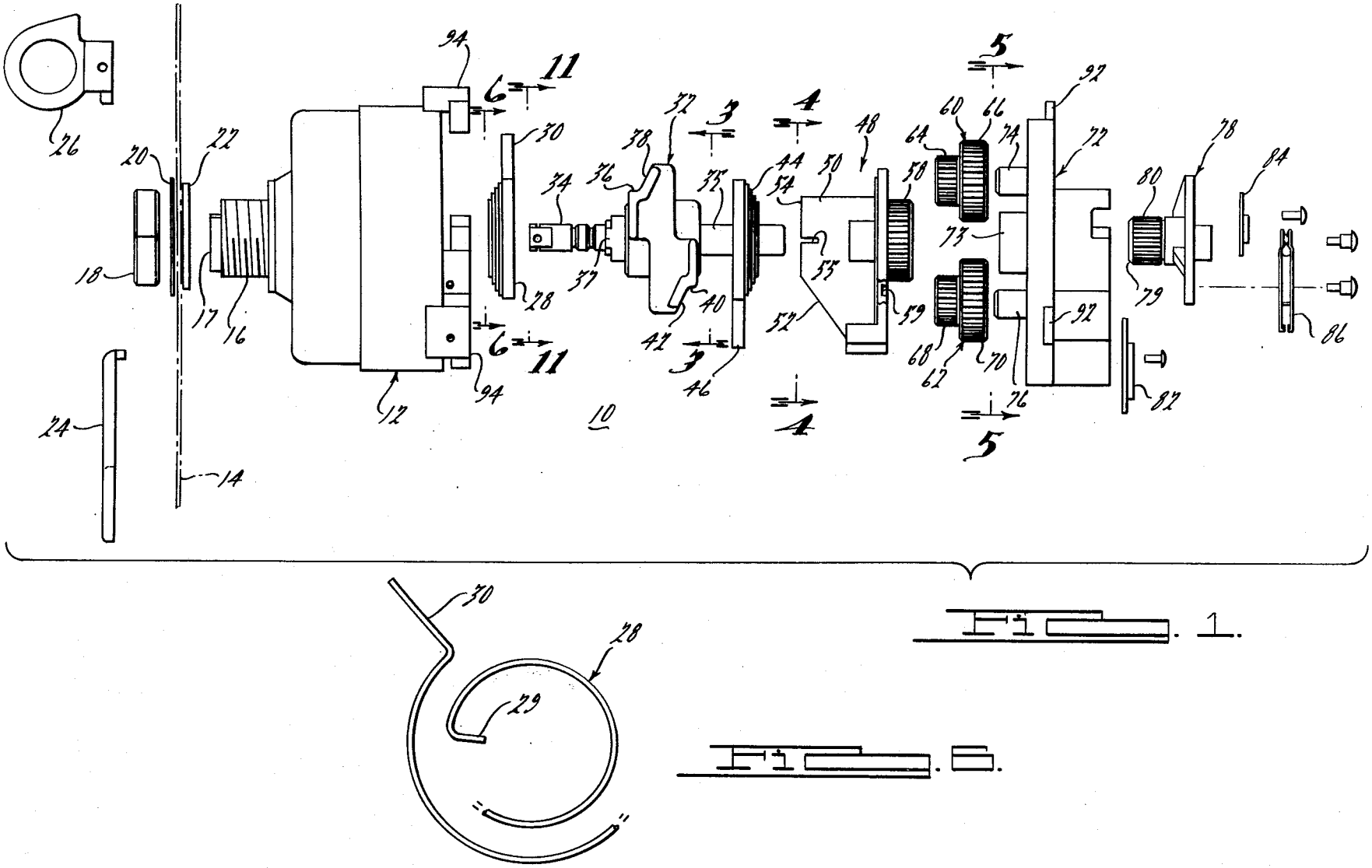
FIG. 1 is an exploded view of a high voltage electrical switch according to the present invention.
Figure 3A:
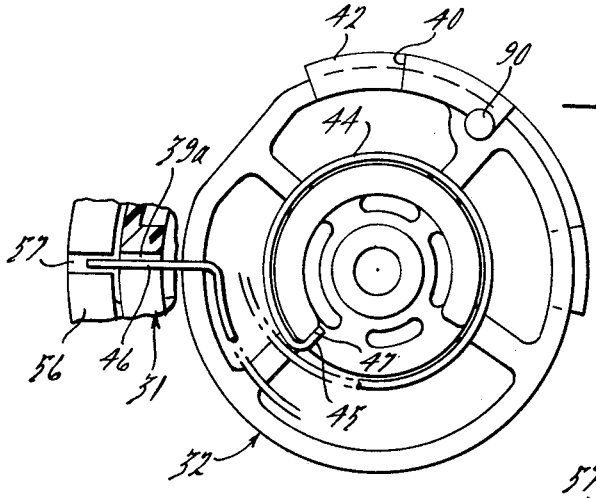
FIG. 3*a* is another view of the cam member shown in FIG. 1 taken along line 3—3.
Figure 3B:
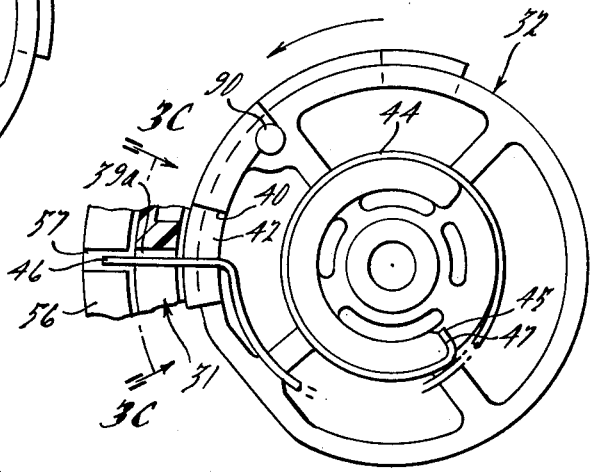
FIG. 3*b* is a view of the cam member shown in FIG. 3*a* rotated approximately 80°.

Looking to FIG. 1, an exploded view of a high voltage rotary type switch according to the present invention is shown. Although the preferred embodiment herein discloses a switch having circular contact movement, it is to be understood that the concepts of the present invention are not limited to circular contact movement nor to switching applications alone. Rather, as will subsequently become more apparent, the concept of directing an extended arc plasma path within a substantially reduced fluid medium switching function encompasses other types of curvilinear contact movement, such as a spiral or complex curve. In addition, arc paths comprising combinations of linear and non-linear movement which provide the advantages herein described may also be utilized. Furthermore, the teachings of the present invention are equally applicable to any application wherein the interruption of a high voltage electrical current is desired. This includes circuit breaker applications, as well as various switching function applications. Moreover, the present invention is not to be construed as limited to movement of a single contact. For example, the generation of a curvilinear path such as a spiral or complex curve can be readily accomplished utilizing multiple contact movement. It is also to be understood that the preferred form of the present invention is readily adaptable to a multiple-pole configuration for use in such applications as the primary switch in a distribution transformer.

The preferred embodiment of a single-pole rotary type high voltage electrical switch 10 according to the present invention comprises a main housing member 12 which is typically mounted to a tank wall 14 by inserting the neck 16 of the housing 12 through an opening prepared in the tank wall 14. The switch housing 12 is secured to the wall 14 by a retaining ring 18 which screws onto the neck 16 of the housing 12. A pair of gaskets 20 and 22 are preferably inserted around the neck 16 of the housing 12 on either side of the tank wall 14 to more rigidly secure the switch housing 12 to the wall 14 in a leak-tight manner.

For reasons that will subsequently become more apparent, the housing 12 is preferably mounted to the tank wall 14 in the position illustrated in FIGS. 8, 10 and 12*a*–*f* so that the rotational path of the movable contact 86 will be centered around the "12 o'clock" position. In this manner, any rise in the gas column surrounding the arc plasma during the switching operation will be away from the input conductor at the center of the switch. However, it is to be understood that the present invention is not limited to this particular arrangement.

Referring to the cross-sectional view of the housing 12 shown in FIG. 2, suspended from the walls of the housing 12 are a pair of radially opposed stops 31 and 33. The location of the stops 31 and 33 within the housing 12 is such that the radial distance between the two stops 31 and 33 is slightly greater than the diameter of the cam 32. This is to permit the cam 32 to rotate freely between the stops 31 and 33 as is required for the cam 32 to function properly. As will be explained in greater detail in connection with the operation of the motor springs 28 and 44, the stops 31 and 33 are positioned to latch the outer tabs 30 and 46 of the front and rear motor springs, 28 and 44 respectively, so that rotational energy can be stored in the motor springs 28 and 44 when the cam 32 is rotated. It will also be noted that the base of the neck 16 contains a recess 19 in the ledge 21 upon which the shoulder 37 of the cam 32 rests when properly positioned within the housing 12. For reasons that will subsequently be explained in detail, the recess 19 is adapted to receive the shoulder 37 of the cam 32 when the cam 32 is rotated within a certain limited position not part of the normal rotational path of the cam 32.

Looking at the detailed views of the stops 31 and 33 shown in FIGS. *2a* and *2b*, the stops 31 and 33 each comprise a short inclined surface 37*a* and 37*b* which leads to a latch 39*a* and 39*b*. Depending upon the direction in which the switch 10 is operated, one of the two motor springs 28 and 44 will encounter one of the stops 31 and 33 toward the end of each switching operation. As the switching operation is completed, the outer tab of this motor spring will ride up the inclined surface of the stop creating a small amount of lateral pressure that insures the proper latching of the motor spring in the stop. Thus, the latched motor spring is prepared to store rotational energy for the return switching operation.

A cam member 32 having a shaft 34 affixed thereto is adapted to be inserted within housing 12 so that the shaft 34 of the cam 32 extends through the neck 16 of the housing 12. Fastened to the end of the cam shaft 34 on the exposed side of the tank wall 14 is an operator's handle 24 and a "hot-stick" handle 26. The two switch handles are merely to provide alternative means of operating the switch 10. Specifically, the switch 10 can be operated directly by either the operator's handle 24 or by hooking a hot stick on the specially designed hot stick handle 26. A ridge 17 partially extending around the periphery of the neck 16 of the housing 12 provides a pair of stop surfaces 17*a* and 17*b*, as best shown in FIG. 2, to limit the rotation of the operator's handle 24 to approximately 115°. This allows for ten additional degrees at either extent of travel of the operator's handle 24 to insure that the motor springs 28 and 44 are properly latched as required. The opposite end of the cam 32 also has protruding therefrom another shaft 35 integral to the cam 32 which provides a common axis of rotation for the drive gear 48 and the contact rotor 78, to be subsequently described.

Located on either end of the cam 32 is a slightly helical-shaped motor spring 28 and 44. The front motor spring 28 is located on the end of the cam 32 with shaft 34 and the rear motor spring 44 is located on the opposite end. The construction of the front and rear motor springs, 28 and 44 respectively, is identical. Looking to FIG. 6, a top view of the front motor spring is shown. As can be seen from FIGS. 1 and 6, the motor spring 28 comprises a plurality of coils, each of which are laterally displaced slightly in relation to the adjacent coil. The resulting helical configuration causes the motor springs to exert lateral pressure toward each other which helps insure proper latching of the motor springs in the stops 31 and 33. As best shown in FIG. 6, the motor spring 28 has an inside tab 29 and an outside tab 30. Projecting the inside tab 29 and the outside tab 30 to the center of the spring 28, the tabs form a 45° angle.

Figure 11A:
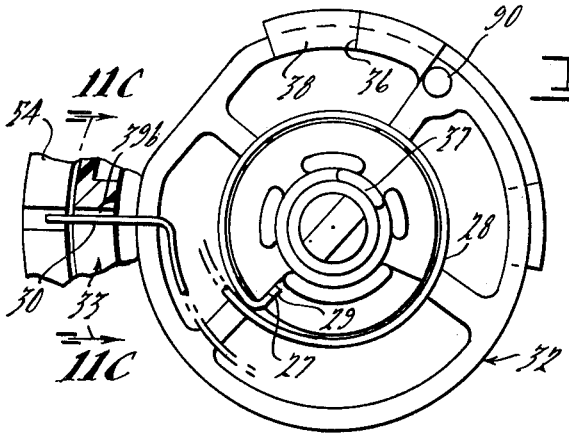
FIG. 11*a* is another view of the cam member shown in FIG. 1 taken along line 11—11.

Turning now to FIG. *3a*, an end view of the cam 32 illustrating the positioning of the rear motor spring 44 in its relaxed state is shown. It is to be understood that the description of FIG. *3a* is equally applicable to the opposite end of the cam 32 and the front motor spring 28 illustrated in FIG. 11*a*. As the drawing illustrates, the cam 32 serves as an arbor around which the motor spring 44 is wound. The inside tab 45 of the motor spring 44 is positioned against the cam surface 47 and the outside tab 46 is latched in the stop 31. As the cam 32 is rotated counterclockwise relative to the figure, the cam surface 47 winds the motor spring 44 thereby storing rotational energy in the motor spring 44. Continued rotation of the cam 32 brings the inclined camming surface 42 of the cam 32 into contact with the outside tab 46 of the motor spring 44 as shown in FIG. *3b*. Referring to FIG. *3c*, as the cam 32 is rotated further, the inclined camming surface 42 raises the outside tab 46 against the lateral bias of the motor spring 44 above the latch 39*a* of the stop 31, thereby releasing the rotational energy stored in the motor spring 44. It will be noted that the complete operation of storing and releasing rotational energy is accomplished by rotating the cam 32 approximately 85°.

Given the fact that the outside tab 46 of the motor spring 44 is mechanically coupled to the movable contact 86 of the switch 10, it will also be noted that in the event that the motor spring 44 does not begin to unwind once freed from the stop 31 due to some type of adhesion between the movable contact 86 and the stationary contact 82, the final few degrees of rotation of the cam 32 will bring the anti-weld surface 40 of the cam 32 into contact with the outside tab 46 of the motor spring 44 to initiate rotation of the movable contact 86. Once the forced movement of the tab 46 has broken the adhesion between the stationary contact and the movable contact 86, the motor spring 44 is free to release its stored rotational energy and complete the switching function.

Returning to FIG. 1, the rear motor spring 44 is held in position against the cam 32 by a drive gear 48 which is journalled to the shaft 35 of the cam 32. Looking additionally to the top view of the drive gear 48 illustrated in FIG. 4, the drive gear 48 is seen to comprise a segmented semi-circular shaped device having a circumferential ridge 50 extending from the periphery of the device parallel to its axis. The ridge of the drive gear 48 extends from a first raised level 56 along an inclination 52 to a second higher level 54. The axial height of the second level 54, hereinafter referred to as drive segment 54, is approximately twice that of the first level 56, hereinafter referred to as drive segment 56. Each of the two drive segments 54 and 56 has formed therein, parallel to the axis of the drive gear 48, a slot or channel 55 and 57 respectively. The channel 57 in drive segment 56 is adapted to receive the outer tab 46 of the rear motor spring 44, and the channel 55 in drive segment 54 is adapted to receive the outer tab 30 of the front motor spring 28. Thus, due to the mechanical connection described between the front and rear motor springs 28 and 44 respectively, and drive gear 48, it can be seen that the drive gear 48 will rotate whenever rotational energy is released from either of the two motor springs 28 and 44.

Affixed to the back side of the drive gear 48 is a spur gear 58 that is aligned with the axis of the drive gear 48. Spur gear 58 is adapted to mesh with a pair of radially opposed idler gears 60 and 62 which are journalled to a pair of posts 74 and 76 extending from a bearing plate 72. Idler gears 60 and 62 each comprise a pair of axially aligned spur gears 64, 66 and 68, 70 respectively. It will be noted that the circumference of spur gear 58 affixed to drive gear 48 is approximately 1.73 times that of spur gears 64 and 68.

Returning momentarily to the illustration of drive gear 48 in FIG. 1, it will be noted that there is formed in the back side of drive gear 48 a circumferential groove 59 defining a diameter slightly larger than the diameter of spur gear 58. The groove 59 in drive gear 48 is adapted to provide a thrust surface to guide the rotation of the drive gear 48. In particular, looking at the front view of the bearing plate 72 illustrated in FIG. 5, it can be seen that the bearing plate 72 contains a pair of semicircular segments 71 and 73 that are adapted to ride within the groove 59 in drive gear 48 as drive gear 48 is rotated. In this manner, the axial alignment between drive gear 48 and bearing plate 72 is maintained when drive gear 48 is rotated so that idler gears 60 and 62 will not bind with spur gear 58.

As can also be seen from FIG. 5, bearing plate 72 has formed therein a center bore 75 having a diameter slightly larger than the diameter of the spur gear 80 integral to the shaft 79 of the contact rotor 78. The shaft 79 of the contact rotor 78 is adapted to fit through the center bore 75 of the bearing plate 72 so that spur gear 80 will mesh with spur gears 66 and 70 of idler gears 60 and 62, respectively. In addition, the hollow shaft 79 of contact rotor 78 is adapted to be journalled to the end of the cam shaft 35 so that the contact rotor 78 will be properly aligned with the other rotating parts of the switch 10. Since the circumferences of spur gears 66 and 70 are also approximately 1.73 times greater than the circumference of spur gear 80, it will be appreciated that a total mechanical overdrive of 3 to 1 is realized between spur gear 58 affixed to drive gear 48 and spur gear 80 affixed to contact rotor 78. Thus, it can be seen that the output rotation of contact rotor 78 will be three times greater than the input rotation of drive gear 48.

The mechanical overdrive provided by idler gears 60 and 62 is important to the design of switch 10 in that it permits extended rotation of the movable contact 86 without requiring increased rotation of the operator's handle 24. Since high voltage switches are typically operated with a hot stick, it will be appreciated that it becomes increasingly difficult to rotate the operator's handle 24 for substantially more than a quarter of a revolution. Thus, it can be seen that the preferred form of the present switch 10 is designed to be easily operated by a hot stick since it requires only 85° rotation of the operator's handle 24.

The movable contact 86 is fastened to the contact rotor 78 on the side opposite the shaft 79 at the center of the contact rotor 78 and at a radially spaced point near its periphery. The specific design of the movable contact 86 comprises part of the present invention and will subsequently be described in greater detail. The stationary contacts 82 and 84 are fastened to a pair of contact mounts 83 and 85 respectively, best shown in FIG. 5, located at circumferentially spaced points along the periphery of the bearing plate 72. Stationary contact 84 is designed to extend from contact mount 85 to the center of contact rotor 78 where it is connected to movable contact 86. Stationary contact 82 is positioned on bearing plate 72 so that it is in physical connection with movable contact 86 at one extent of travel. With an input conductor connected to stationary contact 84 and an output conductor connected to stationary contact 82, it can be seen that when the movable contact 86 is in contact with stationary contact 82, the circuit between the input and output conductors is closed, and when the movable contact 86 has rotated to its opposite extent of travel, the circuit between the input and output conductors is open.

It will be noted at this point that the preferred embodiment of the present invention is specifically designed to be readily assembled without the aid of tools or special hardware. Specifically, since the relative alignment of the various components within the housing 12 is critical to the proper operation of the switch 10, the housing 12, cam member 32, drive gear 48, and bearing plate 72 each have formed therein an alignment hole 90 which is adapted to receive an alignment pin (not shown) which is removed after assembly of the switch 10. In addition, it will be noted that the entire assembly is readily secured within the housing 12 by inserting and rotating the locking tabs 92 that radially extend from the bearing plate 72 into the latches 94, shown in detail in FIG. 2*c*, circumferentially spaced about the periphery of the housing 12. To insure proper alignment between the bearing plate 72 and the housing 12, the locking tabs 92 and latches 94 are not equidistantly spaced. Thus, the bearing plate 72 will latch to the housing 12 in only one position.

As an assurance against accidental disassembly of the switch 10, the depth of the housing 12 is such that the bearing plate 72 will not sit deep enough into the housing 12 to permit the locking tabs 92 of the bearing plate 72 to fit under the catches 95 of latches 94 as long as the shoulder 37 of cam 32 is resting on ledge 21 at the base of housing 12. Thus, to complete assembly of the switch 10, the cam 32 must be rotated to a position aligning the shoulder 37 of the cam 32 with the recess 19 in the ledge 21 of housing 12 to permit the bearing plate 72 to be depressed a sufficient amount so that locking tabs 92 can be rotated and secured in latches 94. It is also to be noted that the shoulder 37 of cam 32 will not align with the recess 19 in ledge 21 in any position of the cam 32 during normal operation of the switch 10. In other words, due to the ridge 17 restricting the rotation of the operator's handle 24, the cam 32 cannot be rotated to the alignment position without first removing the operator's handle 24. Thus, as long as the operator's handle 24 is fastened to the shaft 34 of the cam 32, the switch 10 cannot be disassembled.

Figure 7A:
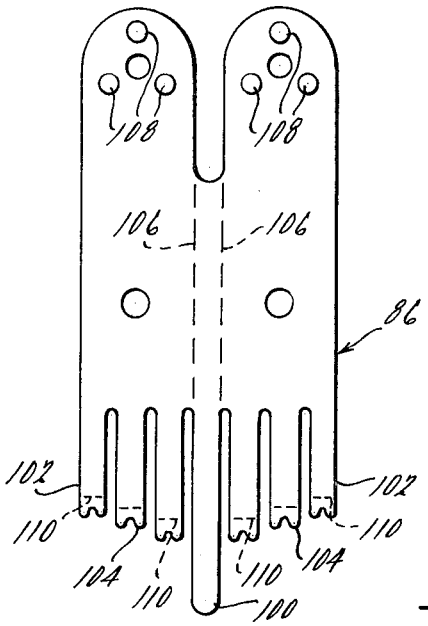
FIG. 7*a* is a detailed view of the movable contact element shown in FIG. 1.

Looking to FIG. 7, the specific construction of the movable contact 86 will now be explained. Movable contact 86 is preferably manufactured out of a single piece of highly conductive metal such as a bronze or copper alloy. As is best shown in FIG. 7*a*, the end of the movable contact 86 is bifurcated into a plurality of parallel conductive strips 102 of varying lengths and a center strip which is employed as a sacrificial segment 100. The conductive strips 102 have irregular shaped tips 104 which provide multiple contact points between the movable contact 86 and the stationary contact 82. In addition, a group of protrusions 108 are formed in the opposite end of movable contact 86 to insure that a proper electrical connection is made between movable contact 86 and stationary contact 84.

Figure 7B:
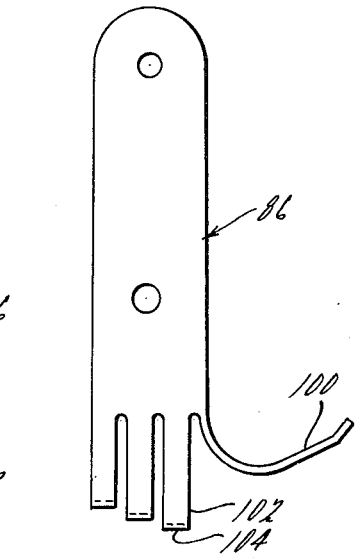
FIG. 7*b* is another view of the movable contact element shown in FIG. 7*a;*

Movable contact 86 is constructed by folding the contact along dotted lines 106 and 108 so that the conductive strips 102 on either side of the sacrificial segment 100 are aligned, as shown in FIG. 7*b*. Next, the ends 104 of the conductive strips 102 are folded inward along dotted lines 110. Finally, the sacrificial segment 100 is bent in a substantially arcual formation, as best shown in FIG. 7*b*. As will subsequently be appreciated from the discussion of the operation of the switch 10, it is important that the maximum radial distance between the sacrificial segment 100 and the axis of rotation of the movable contact 86 is less than the radial distance from the axis of rotation to the end 104 of the shortest conductive strip 102.

Figure 10:
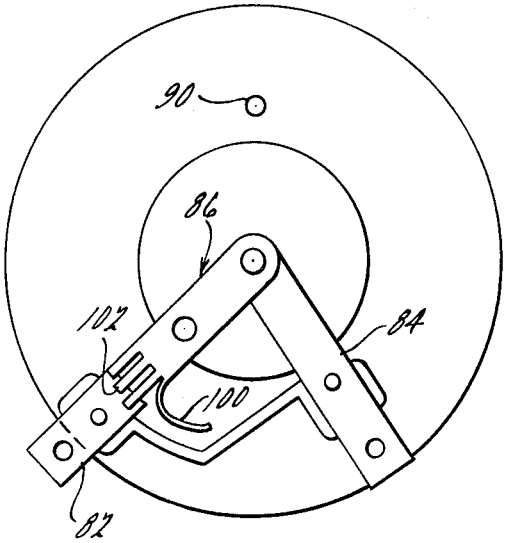
FIG. 10 is a view of the switch according to the preferred embodiment showing the movable contact in the closed position.
Figure 7C:
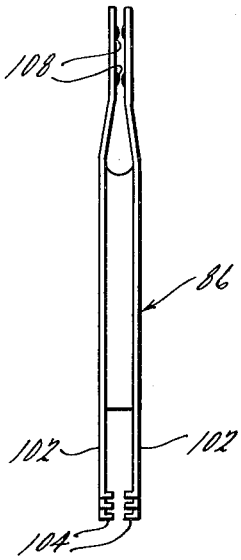
FIG. 7*c* is another view of the movable contact element shown in FIG. 7*b;*
Figure 9:
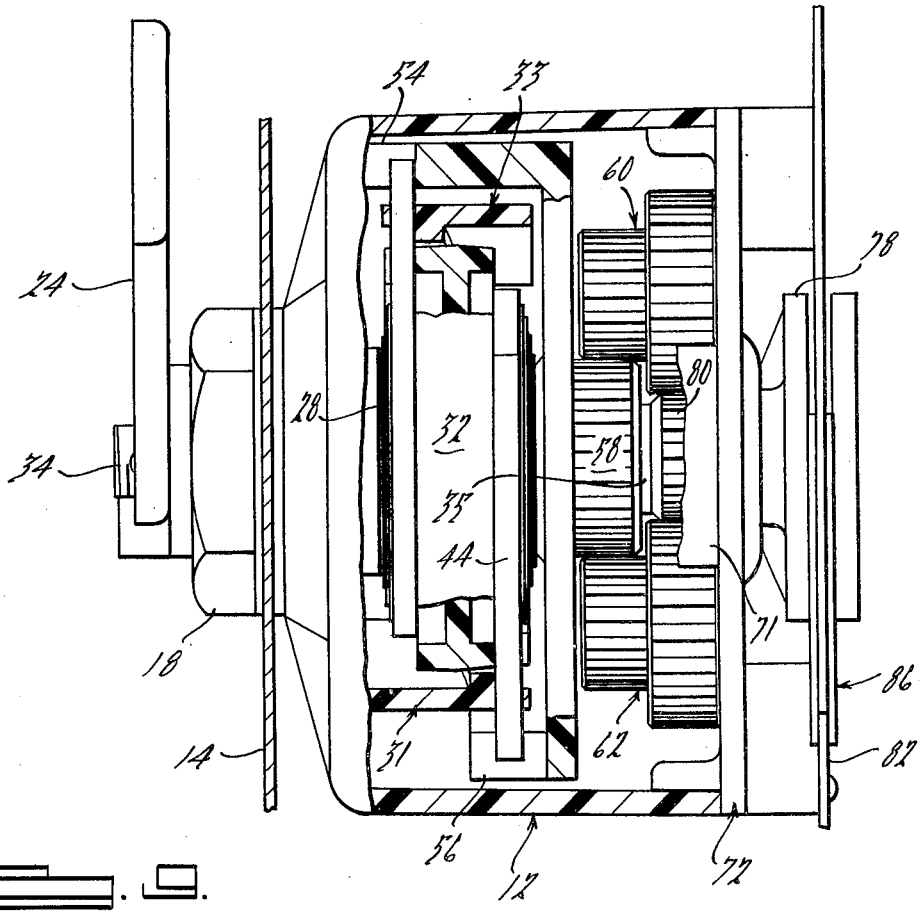
FIG. 9 is a cut-away view showing an assembled switch according to the preferred embodiment.

Looking to FIG. 7*c*, it can be seen from the construction outlined above the the movable contact 86 offers six different electrical contact paths and twelve possible points of contact between the movable contact element 86 and stationary contact 82 when the switch 10 is in the closed position. Thus, as is best shown in FIG. 10, the design of the movable contact 86 insures that a proper electrical connection will be made between movable contact 86 and stationary contact 82 even though portions of either of the contact terminals are eroded or for some other reason unable to conduct current.

Figure 11B:
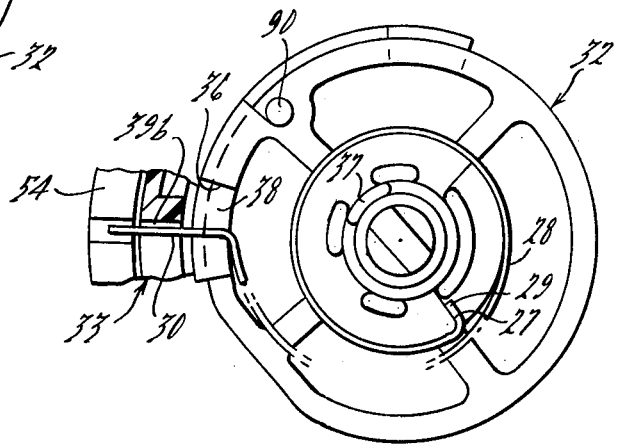
FIG. 11*b* is a view of the cam member shown in FIG. 11*a* rotated approximately 80°.
Figure 11C:
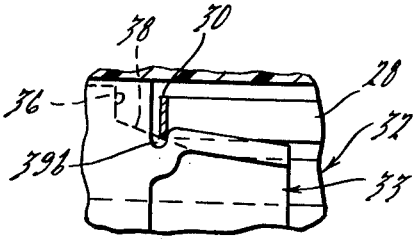
FIG. 11*c* is a view of the cam member and front stop of FIG. 11*b* taken along line *c—c.

Turning now to FIGS. 9 and 11*a–c*, the interplay of the various components during the operation of the switch 10 will now be explained. As previously mentioned, the preferred embodiment of the switch 10 is operated simply by rotating the operator's handle 24 approximately a quarter of a revolution. The rotation of the operator's handle 24 may be accomplished manually or indirectly with a "hot-stick" via the hot-stick switch handle 26. Since the operator's handle 24 is directly coupled to the cam shaft 34, the cam 32 will rotate with the rotation of the operator's handle 24. Assuming the motor spring 28 is latched in stop 33 from the previous switching operation, as the cam 32 is rotated, the cam surface 27 will wind the motor spring 28 storing rotational energy therein. As best shown in FIGS. 11*b* and *c*, continued rotation of the cam 32 brings the inclined camming surface 38 into contact with the outside tab 30 of the motor spring 28, thus raising the tab 30 against the lateral bias of the motor spring 28 out of the stop 33. When the tab 30 clears the stop 33, the rotational energy stored in the motor spring 28 is rapidly delivered to the drive gear 48 via the direct connection between the outside tab 30 of the motor spring 28 and the drive segment 54 of the drive gear 48. The rotation of the drive gear 48 causes the idler gears 60 and 62 to rotate, which in turn drives the spur gear 80 affixed to the contact rotor 78. Due to the mechanical overdrive provided by idler gears 60 and 62, the contact rotor 78 is rotated three times the amount of rotation of the drive gear 48. In addition, if the motor spring 28 is unable to move the drive gear 48 after the tab 30 of the spring 28 has cleared the stop 33 due to adhesion between the contacts, the anti-weld surface 36 of the cam 32 "manually" initiates movement of the outside tab 30 of the motor spring 28 during the final few degrees of rotation of the operator's handle 24. These remaining few degrees of rotation are translated into three times the amount of rotation at the contact rotor 78, which is sufficient to initiate normal operation of the switching function.

It will be noted at this point that as the drive gear 48 is rotated under the power of the front motor spring 28, the rear motor spring 44 is latched in the opposite stop 31. Thus, at the termination of the switching function in one direction, the switch 10 can be returned to its original position simply by reversing the movement of the operator's handle 24. Similarly, when the drive gear 48 is rotated under the power of the rear motor spring 44, the front motor spring 28 is automatically latched in stop 33. Thus, it can be seen that the operation of the preferred embodiment of the present invention combines the steps of storing rotational energy in one motor spring, releasing the stored rotational energy, and latching the opposite motor spring all in the same movement of the operator's handle.

It will also be noted that the movable contact 86 is rotated as rapidly under the power of the rear motor spring 44 as it is under the power of the front motor spring 28. The purpose of providing means for rapidly switching from the open to the closed position is to minimize arcing between the two energized elements as the switch 10 is closed.

Figure 8:
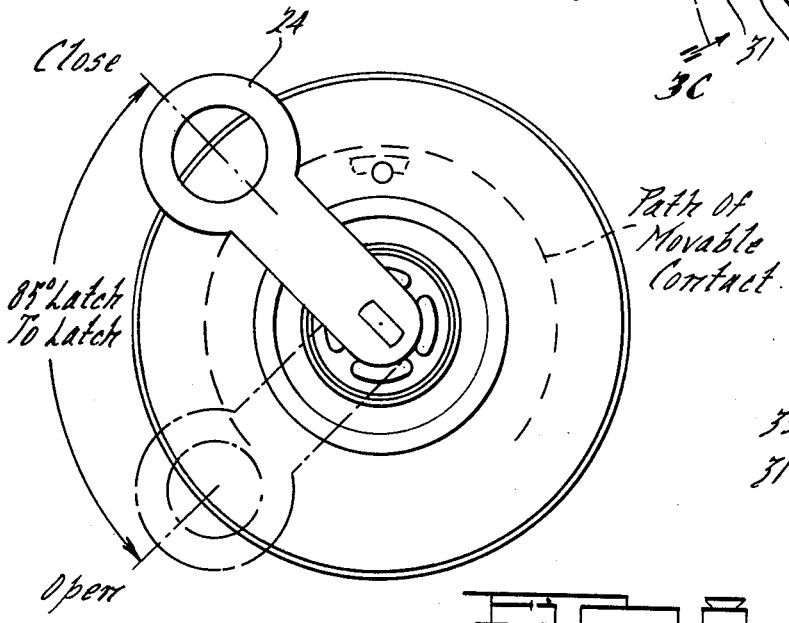
FIG. 8 is a view of the switch according to the preferred embodiment of the present invention showing the relative movements of the operator's handle and the movable contact.
Figure 3C:
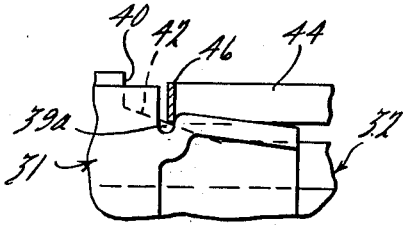
FIG. 3*c* is a sectional view of the cam member and rear stop of FIG. 3*b* taken along line *c—c;*

Looking now to FIG. 8, the extended rotation of the movable contact 86 relative to the rotation of the operator's handle 24 is shown. As the diagram illustrates, entire rotation of the operator's handle 24 is through an arc of roughly 85°. Of this total, approximately the first 57° of rotation are used exclusively to store rotational energy in the motor spring. The next 25° or so are additionally effective to release the motor spring from the stop. And the last few degrees of movement are operative to manually initiate movement of the motor spring in the event that the movable contact 86 has not yet begun to rotate.

As previously mentioned, due to the mechanical overdrive unit, the 85° movement of the operator's handle 24 causes a corresponding rotation of the movable contact through an arc of approximately 255°. The strengths of the motor springs are selected so that total mechanical motion upon the release of their stored rotational energy consumes approximately 25 milliseconds. It will also be noted from the figure that the total distance travelled by the movable contact 86 is substantially greater than the direct distance from the fixed contact 82 to the stationary contact 84 at the center of the switch, or the direct distance from the fixed contact 82 to the movable contact 86 after its rotation has terminated. Specifically, in the preferred embodiment the total length of the curvilinear path travelled by the movable contact 86 is approximately 7.9 inches, whereas the direct distance through the fluid insulating medium from the fixed contact 82 to stationary contact 84 at the center of the switch is approximately 1.5 inches. However, even though there exists within the switch 10 a relatively short path between two points exposed to electrical stress, the preferred embodiment of the switch 10 has the capacity to successfully interrupt a high voltage current that is capable of generating and maintaining an arc plasma that extends over a distance of approximately 7.5 inches i.e., substantially more than $\pi/2$ times the direct distance between contacts 82 and 84.

In order for a relatively small switch as disclosed in the preferred embodiment to handle voltages normally requiring switches of substantially greater size, it is necessary to accurately control the parameters within the switch that define the arc plasma path. More specifically, it has been found that when an arc plasma occurs between points of transmission during a switching operation, a gas bubble is generated by the intense heat within the arc plasma. As the arc plasma is expanded by movement of the contacts relative to one another, the gas bubble assumes a column-like form around the arc plasma. As the arc plasma is extended by movement of the contacts relative to one another, the gas bubble assumes a column-like form around the arc plasma. Furthermore, it has been found that when the switching function is confined to a fluid insulating medium having a relatively high dielectric strength, the arc plasma will remain within the gas column since the dielectric strength of the gas column is substantially less than that of the surrounding fluid.

It is to be understood at this point that when the arc plasma is said to be confined within a column-like form of gas, it is not meant to imply that a definite boundary exists within which the arc plasma is located. Nor, is it meant to imply that the gas generated by the arc plasma forms a readily recognizable, perfectly shaped column capable of sharp definition. Rather, since the arc plasma does not form a perfectly defined "beam" of uniform intensity, the surrounding gas is similarly non-uniform and somewhat scattered. However, the arc plasma does substantially follow an arcuate path traced by the rotation of the movable contact 86 and therefore, due to the fact that the gas is generated by the heat of the arc plasma, the term "column" is adopted as a term of art to identify the idealized area of gas concentration. Thus, in actuality, the arc plasma is substantially confined to an area defined by the presence of a concentration of gas which substantially surrounds the path of the arc plasma.

However, since the gas generated by the arc plasma is substantially lighter than the fluid, the gas column will tend to rise within the fluid. Thus, it becomes important that the time period of the switching operation remain sufficiently short so that the gas column does not appreciably rise within the fluid insulating medium. In addition, as previously stated, the switch 10 is preferably installed so that the rotational path of the movable contact 86 is substantially centered around the "12 o'-clock" position. In this manner, any movement of the gas during the switching operation is directed away from the center conductor 84 of the switch 10. In the preferred embodiment, the 25 milliseconds total switching time is small enough so that very little gas column movement occurs. Thus, with a virtually stationary gas column, it becomes possible to confine the arc plasma to the gas column within certain parameters. These parameters relate to the various dielectric strengths in the switch environment under the dynamic conditions of the switching operation.

Specifically, the dielectric strength of the gas column between the contacts must be less than the dielectric strength between all other possible paths exposed to electrical stress. Thus, in the preferred embodiment of the switch, the dielectric strength of a gas column approximately 7.9 inches in length must be substantially less than the dielectric strength through approximately 1.5 inches of fluid insulating medium. In addition, the dielectric strength of the gas column must initially be less than the ceiling dielectric strength necessary to support the arc plasma. And finally, at its maximum length, the dielectric strength of the gas column, and the entire switch environment, must all be above the ceiling dielectric strength required to support the arc plasma, so that the arc plasma will cease.

Thus, it can be seen that by directing the path of the gas column by controlling the relative contact movement, an arc plasma path can successfully be guided in any configuration as long as: (1) the relative dielectric strength of the gas column is below the conductivity ceiling of the arc plasma while all other dielectric strengths exposed to electrical stress are substantially above the arc plasma's conductivity ceiling; and (2) the relative dielectric strength of the gas column is lower than any column-to-column dielectric strengths where parallel or closely intersecting column paths are used. In other words, the arc plasma will follow the gas column as long as its dielectric strength is below the conductivity ceiling of the arc plasma and it offers substantially the lowest resistance to current flow within the switch system. In addition, with the dielectric strengths of all other areas within the switch system above the conductivity ceiling, the arc plasma will be discontinued when the dielectric strength of the gas column rises above the conductivity ceiling.

Thus, it will be appreciated that various curvilinear contact paths other than circular are possible. For example, axial movement can be added to the circular contact movement of the preferred embodiment to generate a spiral. In addition, multiple contact movement can be employed to generate a variety of complex curves. However, these alternatives require more complicated switching mechanisms than that disclosed in the preferred embodiment.

It should be understood at this point that the conductivity ceiling of the arc plasma is dependent upon the temperature of the arc. Accordingly, when it is stated herein that the conductivity ceiling of the arc plasma is exceeded by the dielectric strength of the gas column, it is inferred that the temperature of the arc plasma has fallen below the minimum temperature necessary to support the arc plasma within the gas column. It is my belief, that it is the dissipation into the surrounding fluid insulating medium of the heat generated by the arc plasma which causes the arc plasma to extinguish. Thus, applying this to the present invention, by controlling the generation of an extended arc, the switch 10 substantially increases the total interface between the arc plasma and the surrounding fluid insulating medium. This, it is believed, results in a sufficient cooling of the arc plasma to cause the arc plasma to deionize and extinguish.

Figure 12A:
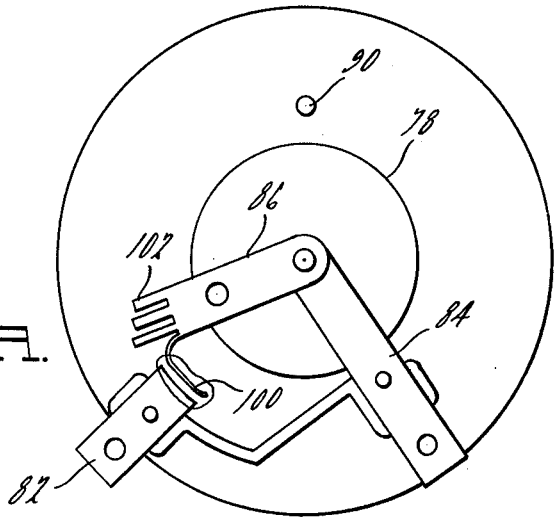
* and FIGS. 12*a*–12*f* are a sequence of views illustrating the operation of the preferred embodiment of the switch.
Figure 12B:
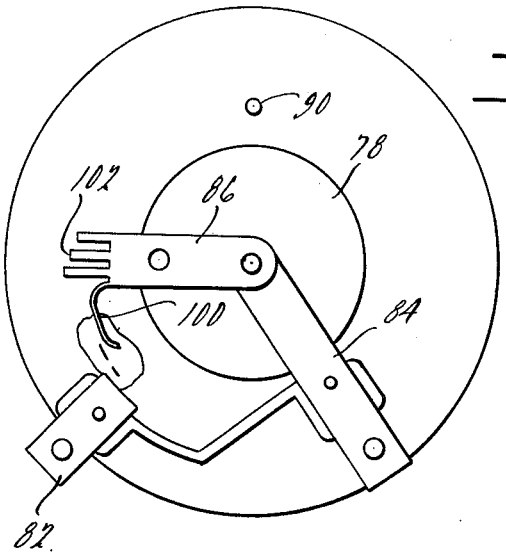

Referring to FIGS. **12*a*–12*f*, the operation of the switching function will now be explained. FIGS. 12*a*–12*f* sequentially illustrate the operation of the switch 10 and in particular the formation of the gas column that surrounds the arc plasma as it traces the path of the movable contact 86. The dotted line in the Figures is intended to indicate the actual path of the arc plasma within the surrounding gas column. As the movable contact 86 separates from the stationary contact 82, arc plasma is created. As best shown in FIG. 12*a*, during the first few degrees of rotation, the sacrificial segment 100 of the movable contact 86 passes within close proximity of the stationary contact 84. In particular, it will be noted that after the initial few degrees of rotation, the sacrificial segment 100 is closer to the stationary contact 82 than the contact segments 102 of the movable contact 86. This causes the arc plasma to be directed between the sacrificial segment 100 and the stationary contact 82 during rotation of the movable contact 86. In this manner, the contact segments 102 of the movable contact 86 are not exposed to the eroding effect of the arc plasma. Thus, it will be appreciated that the preferred design of the movable contact 86 permits the switch 10 to be operated without deterioration of the contact segments 102 which, if damaged, could prevent the switch 10** from operating properly.

Referring to FIG. **12*b*, as the movable contact 86 continues to rotate from the stationary contact 82, the length of the arc plasma increases as it traces the path of the sacrificial segment 100. As previously explained, the path of the arc plasma will be confined to the path of the sacrificial segment 100** due to the reduced resistance that exists within the gas column formed around the arc plasma.

Figure 12C:
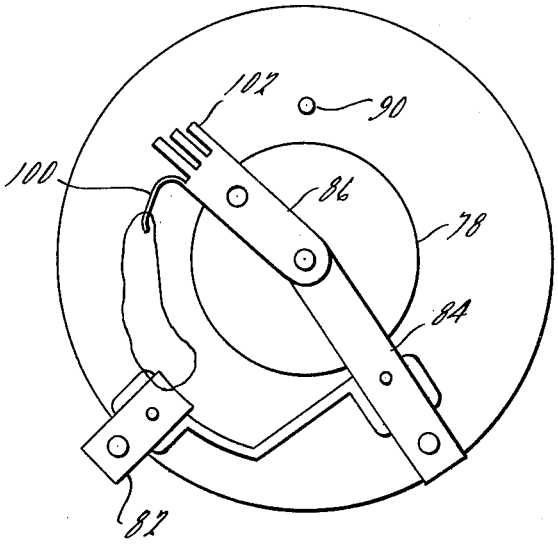
Figure 12D:
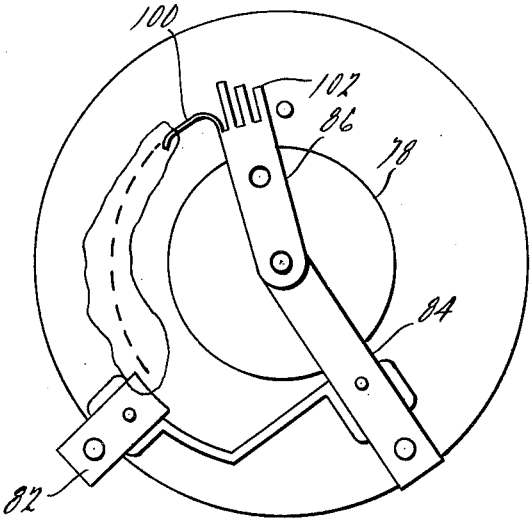
Figure 12E:
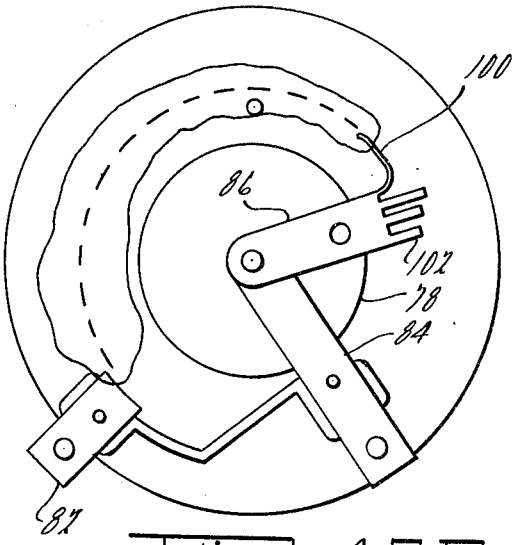
Figure 12F:
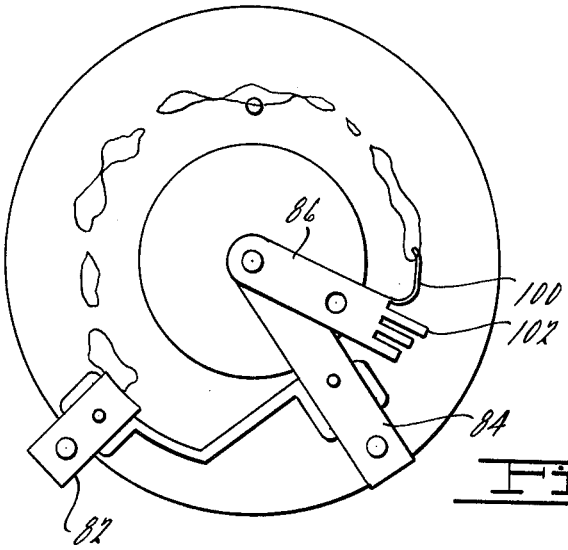

Assuming that the current applied to the switch 10 is 60-cycle alternating current, it will be understood that the magnitude of the current will go to zero 120 times every second. In other words, a zero cross-over point will appear approximately every 8 milliseconds. Thus, during the first 8 milliseconds of contact movement, the arc plasma will extinguish, as shown in FIG. 12*c*, and subsequently restrike the circular path between sacrificial segment 100 and the stationary contact 84. However, due to the extremely brief duration of the period of zero current, the gas column does not dissipate to any significant degree. It is to be understood that since there is no way of predicting where within its cycle the external alternating current will be when the switching operation is initiated, the first zero cross-over point can occur at any time during the first 8 milliseconds of switching time. Approximately 8 milliseconds after the first zero cross-over, after the movable contact 86 has rotated another 80° or so, the arc plasma will again extinguish itself and restrike the curvilinear path traced by the rotation of the sacrificial segment 100. Finally, as illustrated in FIG. 12*f*, when the third zero cross-over point occurs, the movable contact 86 will have rotated substantially its entire extent of travel. Due to the increased dielectric strength of the extended gas column at this point, the arc plasma will be unable to restrike the curvilinear path defined by the gas column after it extinguishes for the third time. Thus, the arc plasma will terminate, interrupting the flow of current between the movable contact 86 and the stationary contact 82, and the gas column will dissipate, as illustrated, into the surrounding fluid medium.

It should be noted that when the switch 10 is applied to electrical currents of greater or lesser frequencies, the number of zero cross-over points will vary from this example.

Finally, in the event the switch 10 is operated under a "fault make" situation, such as would occur if there existed a short in the line at the time of the switching operation, the switch 10 is designed so that minimal damage will occur. Specifically, the sacrificial segment 100 is adapted to be consumed under such a condition to prevent damage to the remainder of the movable contact 86 and the other switching elements in the switch 10 exposed to electrical stress.

While it will be apparent that the preferred embodiment of the invention disclosed is well calculated to fulfill the objects above stated, it will be appreciated that the invention is susceptible to modification, variation and change without departing from the proper scope and fair meaning of the subjoined claims.

I claim:

1. A device for interrupting high voltage electrical currents capable of generating arc plasma when points of transmission are separated including:

a stationary energized element;

a movable energized element adapted to make electrical contact with said stationary element in a first position; and motive means for interrupting the electrical connection between said elements in said first position by rapidly rotating said movable element about an axis in a circular path from said stationary element over a circumferential distance substantially greater than 180° within a predetermined time period, so that the arc plasma generated by the separation of said elements substantially traces the circular path of said movable element until said arc plasma is extinguished.

2. The device of claim 1 wherein said motive means is adapted to rotate said movable element approximately three quarters of a revolution in approximately 25 milliseconds time.

3. The device of claim 1 further including input means for supplying rotational energy to said motive means.

4. The device of claim 3 further including a cam member connected between said input means and said motive means and adapted to store rotational energy supplied by said input means in said motive means upon the rotation of said cam member by said input means a first predetermined number of degrees, and further adapted to release the rotational energy stored in said motive means upon the further rotation of said cam member by said input means a second predetermined number of degrees.

5. The device of claim 4 wherein said cam member is still further adapted to initiate rotation of said movable element upon the still further rotation of said cam member by said input means a third predetermined number of degrees in the event that said motive means is unable to initiate rotation of said movable element after said cam member has rotated said second predetermined number of degrees.

6. The device of claim 3 wherein said motive means includes overdrive means for providing a greater amount of rotation to said movable element than is supplied by said input means.

7. The device of claim 6 wherein said input means is adapted to supply approximately one quarter of a revolution of rotational energy to said motive means and said overdrive means is adapted to rotate said movable element approximately three quarters of a revolution.

8. The device of claim 1 wherein said movable element includes a first part comprising a plurality of segments of varying lengths adapted to make contact with said stationary element at a plurality of different locations in said first position.

9. The device of claim 8 wherein each of said plurality of segments has more than one contact point.

10. The device of claim 1 wherein said movable energized element includes a first part adapted to make contact with said stationary element in said first position and a second part adapted to come within close proximity of said stationary element after said first part has separated from said stationary element so that said arc plasma forms between said stationary element and said second part of said movable element during rotation of said movable element.

11. The device of claim 10 wherein said second part of said movable energized element is further adapted to be consumed by said arc plasma in the event said device is operated under a fault-make situation.

12. The device of claim 1 wherein said energized elements are immersed in a fluid insulating medium.

13. The device of claim 12 wherein said arc plasma is of sufficient magnitude to generate a gas around said arc plasma, and said predetermined time period is sufficiently limited to prevent significant movement of said gas.

14. The device of claim 4 wherein said motive means includes a first motor spring for rotating said movable element in one direction and a second motor spring for rotating said movable element in the opposite direction.

15. The device of claim 14 further including first latching means for latching said first motor spring to prevent said first motor spring from rotating said movable element until said first motor spring is released by said cam member, and means for automatically latching said first motor spring in said first latching means as said movable element is rotated by said second motor spring.

16. The device of claim 14 further including second latching means for latching said second motor spring to prevent said second motor spring from rotating said movable element until said second motor spring is released by said cam member, and means for automatically latching said second motor spring in said second latching means as said movable element is rotated by said first motor spring.

17. A device for interrupting high voltage electrical currents capable of generating arc plasma when points of transmission are separated including:

a stationary energized element immersed in a fluid insulating medium;

a movable energized element immersed in said fluid insulating medium adapted to make electrical contact with said stationary element in a first position; and motive means for interrupting the electrical connection between said elements in said first position by rapidly rotating said movable element within said fluid insulating medium about an axis in a circular path from said stationary element over a circumferential distance substantially greater than 180°, so that the arc plasma generated by the separation of said elements substantially traces the circular path of said movable element until the resistance along said circular path between said energized elements exceeds the conductivity ceiling of said arc plasma.

18. A device for interrupting a predetermined high voltage electrical current capable of generating arc plasma when points of transmission are separated including:

a first energized element;

a second energized element adapted to make electrical contact with said first energized element in a first position; and means for interrupting the electrical connection between said elements in said first position by rapidly displacing said first energized element relative to said second energized element within a predetermined time period over a path substantially greater than $\pi/2$ times the resulting direct distance between said energized elements at the termination of said displacement while generating said arc plasma, so that the arc plasma generated by the separation of said elements substantially traces said path of displacement until said arc plasma is extinguished at least by the end of said path of displacement.

19. The device of claim 18 wherein said path of displacement is curvilinear.

20. The device of claim 19 wherein said means is adapted to displace one of said energized elements over said curvilinear path.

21. The device of claim 20 wherein said means is adapted to rotate said first energized element over a circular path greater than 180°.

22. The device of claim 18 wherein said first energized element includes a first part comprising a plurality of segments of varying lengths adapted to make contact with said second energized element at a plurality of different locations in said first position.

23. The device of claim 22 wherein each of said plurality of segments has more than one contact point.

24. The device of claim 18 wherein said first energized element includes a first part adapted to make contact with said second energized element in said first position and a second part adapted to come within close proximity of said second energized element after said first part has separated from said second energized element so that said arc plasma forms between said second energized element and said second part of said first energized element during displacement of said energized elements.

25. The device of claim 24 wherein said second part of said first energized element is further adapted to be consumed by said arc plasma in the event said device is operated under a faultmake situation.

26. The device of claim 18 wherein said energized elements are immersed in a fluid insulating medium.

27. The device of claim 26 wherein said arc plasma is of sufficient magnitude to generate a gas around said arc plasma, and said predetermined time period is sufficiently limited to prevent significant movement of said gas.

28. A device for interrupting a predetermined high voltage electrical current capable of generating arc plasma when points of transmission are separated including:

a first energized element;

a second energized element adapted to make electrical contact with said first energized element in a first position; and means for interrupting the electrical connection between said elements in said first position by rapidly displacing said first element relative to said second element within a predetermined time period over a path comprising a first segment wherein the direct distance between said first and second energized elements is increased to a maximum and a second segment wherein the direct distance between said first and second energized elements is decreased and the length of said path of displacement is substantially increased while generating said arc plasma, so that the arc plasma generated by the separation of said elements substantially traces said path of displacement until said arc plasma is extinguished at least by the end of said path of displacement.

29. The device of claim 28 wherein said path of displacement is curvilinear.

30. The device of claim 29 wherein said means is adapted to displace one of said energized elements over said curvilinear path.

31. The device of claim 30 wherein said means is adapted to rotate said first energized element over a circular path greater than 180°.

32. The device of claim 29 wherein said first energized element includes a first part comprising a plurality of segments of varying lengths adapted to make contact with said second energized element at a plurality of different locations in said first position.

33. The device of claim 32 wherein each of said plurality of segments has more than one contact point.

34. The device of claim 29 wherein said first energized element includes a first part adapted to make contact with said second energized element in said first position and a second part adapted to come within close proximity of said second energized element after said first part has separated from said second energized element so that said arc plasma forms between said second energized element and said second part of said first energized element during displacement of said energized elements.

35. The device of claim 34 wherein said second part of said first energized element is further adapted to be consumed by said arc plasma in the event said device is operated under a faultmake situation.

36. The device of claim 29 wherein said energized elements are immersed in a fluid insulating medium.

37. The device of claim 36 wherein said arc plasma is of sufficient magnitude to generate a gas around said arc plasma, and said predetermined time period is sufficiently limited to prevent significant movement of said gas.

38. A device for interrupting high voltage electrical current including:

a stationary energized element;

a movable energized element in contact with said stationary element when said current is not interrupted;

motive means including overdrive means connected to said movable element for interrupting said electrical current by rapidly rotating said movable element approximately three quarters of a revolution from said stationary element upon the release of rotational energy stored in said motive means;

a cam member connected to said motive means for storing rotational energy in said motive means upon the rotation of said cam member a first predetermined number of degrees, and for releasing the rotational energy stored in said motive means upon the further rotation of said cam member a second predetermined number of degrees; and input means connected to said cam member for rotating said cam member approximately a quarter of a revolution to provide said approximately three quarters of a revolution of said movable element by said overdrive means.

39. The device of claim 38 wherein said cam member is further adapted to initiate rotation of said movable element upon still further rotation of said cam member a third predetermined number of degrees in the event that said motive means is unable to initiate rotation of said movable element after said cam member has rotated said second predetermined number of degrees.

40. The device of claim 38 wherein said motive means includes a first motor spring for rotating said movable element in one direction and a second motor spring for rotating said movable element in the opposite direction.

41. The device of claim 40 further including first latching means for latching said first motor spring to prevent said first motor spring from rotating said movable element until said first motor spring is released by said cam member, and means for automatically latching said first motor spring in said first latching means as said movable element is rotated by said second motor spring.

42. The device of claim 40 further including second latching means for latching said second motor spring to prevent said second motor spring from rotating said movable element until said second motor spring is released by said cam member, and means for automatically latching said second motor spring in said second latching means as said movable element is rotated by said first motor spring.

43. A device for interrupting high voltage electrical current including:

a stationary energized element;

a movable energized element in contact with said stationary element when said current is not interrupted;

motive means connected to said movable element for interrupting said electrical current by rapidly rotating said movable element from said stationary element upon the release of rotational energy stored in said motive means;

input means adapted to supply the rotational energy that is stored in said motive means; and a cam member connected to said input means for releasing the rotational energy stored in said motive means upon the rotation of said cam member a first predetermined number of degrees, and for initiating movement of said movable element upon further rotation of said cam member a second predetermined number of degrees in the event that said motive means is unable to initiate rotation of said movable element after said cam member has rotated said first predetermined number of degrees.

44. The device of claim 43 wherein said cam member is further adapted to store rotational energy in said motive means as said cam member is rotated said first predetermined number of degrees.

45. The device of claim 43 wherein said motive means includes overdrive means connected to said movable element for providing a greater amount of rotation to said movable element than is supplied by said input means.

46. The device of claim 43 wherein said motive means includes a first motor spring for rotating said movable element in one direction and a second motor spring for rotating said movable element in the opposite direction.

47. The device of claim 46 further including first latching means for latching said first motor spring to prevent said first motor spring from rotating said movable element until said first motor spring is released by said cam member, and means for automatically latching said first motor spring in said first latching means as said movable element is rotated by said second motor spring.

48. The device of claim 46 further including second latching means for latching said second motor spring to prevent said second motor spring from rotating said movable element until said second motor spring is released by said cam member, and means for automatically latching said second motor spring in said second latching means as said movable element is rotated by said first motor spring.

49. A device for interrupting high voltage electrical current including:

a stationary energized element;

a movable energized element adapted to make contact with said stationary element in a first position;

motive means for storing and rapidly delivering rotational energy stored therein;

input means operable by movement thereof by an operator of said interrupting device for supplying rotational energy to said motive means for storage therein and for causing said motive means to rapidly deliver said rotational energy stored therein; and overdrive means having its output thereof connected to said movable element and its input thereof connected to said motive means, said overdrive means being adapted to provide a greater amount of rotation at its output to said movable element than is received at its input from said motive means and being adapted to rapidly rotate said movable energized element independently of the rate of movement of said input means by said operator so that the arc plasma generated by the separation of said elements substantially traces the path of said movable energized element until said arc plasma is extinguished.

50. A device for interrupting high voltage electrical current including:

a stationary energized element;

a movable energized element adapted to make contact with said stationary element in a first position;

motive means for rapidly delivering rotational energy stored therein;

input means for supplying rotational energy to said motive means;

a cam member connected between said input means and said motive means and adapted to store rotational energy supplied by said input means in said motive means upon the rotation of said cam member by said input means a first predetermined number of degrees, and further adapted to release the rotational energy stored in said motive means upon the further rotation of said cam member by said input means a second predetermined number of degrees; and overdrive means having its output thereof connected to said movable element and its input thereof connected to said motive means, said overdrive means being adapted to provide a greater amount of rotation at its output to said movable element than is received at its input from said motive means.

51. The device of claim 50 wherein said cam member is still further adapted to initiate rotation of said movable element upon the still further rotation of said cam member by said input means a third predetermined number of degrees in the event that said motive means is unable to initiate rotation of said movable element after said cam member has rotated said second predetermined number of degrees.

52. The device of claim 49 wherein:

said motive means includes a drive member having affixed thereto a drive gear;

said movable element is affixed to a bearing member having affixed thereto a driven gear; and said overdrive means comprises at least one idler gear comprising an integral pair of axially aligned spur gears having different circumferences, said idler gear being disposed relative to said drive member and said bearing member so that the smaller of said pair of spur gears meshes with said drive gear and the larger of said pair of spur gears meshes with said driven gear.

53. The device of claim 52 wherein the circumference of said drive gear is approximately 1.73 times the circumference of said smaller spur gear and the circumference of said larger spur gear is approximately 1.73 times the circumference of said driven gear, so that said driven gear will rotate approximately three times as much as said drive gear.

54. A device for interrupting a predetermined high voltage electrical current capable of generating arc plasma when points of transmission are separated including:

a first energized element immersed in a fluid insulating medium having a first of said points of transmission;

a second energized element immersed in said fluid insulating medium having a second of said points of transmission; and means for interrupting the electrical connection between said points of transmission in said first position by rapidly displacing said first energized element relative to said second energized element so that said first point of transmission traverses a path within said fluid insulating medium so that the direct distance between said points of transmission initially increases and thereafter substantially decreases near the termination of said displacement while generating said arc plasma, said displacement being sufficiently rapid so that the arc plasma generated by the separation of said elements substantially traces said path of displacement until the heat generated by said arc plasma is sufficiently dissipated into said fluid insulating medium to cause said arc plasma to extinguish at least by the end of said path of displacement.

55. The device of claim 1 wherein said motive means rotates said movable energized element in a controlled rapid manner so that said arc plasma generated by the separation of said elements substantially remains along said circular path of said movable element within a fluid dielectric medium until said arc plasma is extinguished solely due to the controlled rapid manner of rotation of said movable energized element.

56. The device of claim 18 further including input means having an operator's member which is adapted for movement by an operator for supplying energy to said interrupting means for displacing said first energized element relative to said second energized element and wherein said interrupting means is adapted for rapidly displacing said first energy element relative to said second element independently of the rate of movement of said operator's member by said operator.

57. The device of claim 18 wherein said interrupting means displaces said movable element in a controlled rapid manner so that said arc plasma generated by the separation of said elements remains substantially along said path of said movable element within a fluid dielectric medium until said arc plasma is extinguished solely due to the controlled rapid manner of displacement of said movable element.

58. The device of claim 1 including means for mounting said device so that said circular path is substantially disposed upwardly of said movable energized element.

* * * * *